US006237209B1

(12) United States Patent
Leibolt

(10) Patent No.: US 6,237,209 B1
(45) Date of Patent: May 29, 2001

(54) REMOVABLE SUBMARINE SENSOR IN AN ELASTOMER COATING

(75) Inventor: Edward A. Leibolt, Wheaton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/293,777

(22) Filed: Apr. 19, 1999

(51) Int. Cl.[7] ..... B23P 17/00
(52) U.S. Cl. ..... 29/423; 29/527.2; 425/812
(58) Field of Search ..... 29/423, 527.2; 425/812

(56) References Cited

U.S. PATENT DOCUMENTS 5,832,604 * 11/1998 Johnson et al. ..... 29/888.02

* cited by examiner

*Primary Examiner*—S. Thomas Hughes
*Assistant Examiner*—John C. Hong
(74) *Attorney, Agent, or Firm*—Howard Kaiser

(57) ABSTRACT

The invention features utilization of a duplicate form for creating a conformal cavity which equally mates with an original form having the same shape as the duplicate form. The duplicate form is situated in the wall from the inside of the wall, elastomer is cured onto the outside of wall and around the duplicate form, the duplicate form is removed, and the original form is situated in place of the duplicate form. The shape of the hole in the wall is not in strict conformity with the shape of the duplicate form and the original form, but rather is characterized by a small aberration which leaves a space when either the duplicate form or the original form is situated in the hole. This small aberration, together with the elastomeric quality of the cured material, permits ingressive venting during removal of the duplicate form and egressive venting during insertion of the original form. In typical inventive practice, the manipulative steps are performed from the inside of the wall. Facilely and expeditiously, the invention achieves tight installation of the original form.

20 Claims, 10 Drawing Sheets

REMOVABLE SUBMARINE SENSOR IN AN ELASTOMER COATING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to methods, systems and apparatuses for effecting installation of devices, more particularly for installing instruments such as sensors in elastomerically coated structures such as submarine hulls.

The U.S. Navy implements electronic sensors which are situated in elastomer-coated submarine hulls.

According to a method conventionally used by the U.S. Navy for installing an electronic sensor in an elastomer-coated submarine hull, the elastomer is cast around the sensor, which is situated at the outside of the hull. This old method proves successful, and provides minimal or no gap between the sensor and the surrounding elastomer. However, this method is time consuming. Moreover, removal of the sensor requires cutting and/or grinding of the elastomeric material around the sensor, while working from the exterior of the submarine. Furthermore, the process of cutting and/or grinding may damage the sensor.

Another technique commonly used by the U.S. Navy is to cast the elastomer on the outside of the hull, and to cut a hole in the elastomer, thereby permitting the sensor to be installed from the exterior of the submarine. This method allows for easy installation and removal of the sensor. However, this method as well is time consuming. In addition, this method does not necessarily provide minimal or no gap between the sensor and the elastomer.

SUMMARY OF THE INVENTION

It is therefore an object of the present invention to provide an efficient and effective method for installing a sensor in an elastomer-coated submarine hull.

A notable realm of inventive application is that involving submarines. According to many such inventive embodiments, a device (e.g., an electronic sensor) is inventively rendered removably installed in a cured elastomer-coated submarine hull. Inventively utilized is a plug (preferably a structurally solid plug) having a three-dimensional geometrical shape which is identical to that of the device to be installed.

Typical embodiments of the inventive methodology generally include the following steps or stages:

I. An opening in a hull (or other wall-like structure) is (or has been) produced, such hull opening having a shape which comports with that of the plug, except for a relatively small peripheral hole which will permit insertion of a tube adjacent the plug once the plug is installed in the hull opening.

II. A solid plug is (or has been) produced, such solid plug having the same geometrical shape as that of the to-be-installed device.

III. The plug is coated with a mold release agent, for many inventive embodiments preferably a water soluble mold release agent such as polyvinyl alcohol (PVA).

IV. The practitioner working from the inside of the hull, the plug is installed in the hull opening prior to casting the elastomer to the hull. Such installation is accomplished whereby the plug is even or flush, or substantially so, with respect to the hull opening, except for the small peripheral hole.

V. The elastomer (e.g., viscoelastic material) is cast and cured with respect to the outside of the hull. What was previously a bare structural hull has now become an externally cured-elastomer-coated hull.

VI. After the elastomer has been cast and cured, a small diameter venting tube (e.g., a tube made of metal) is inserted by the practitioner(s) (who is/are working from the inside of the hull). It is preferable inventive practice for many inventive embodiments that the venting tube be lubricated (with a lubricating agent such as that used for lubricating the device as described in step VIII hereinbelow) prior to insertion. While inserted, the venting tube proceeds first through the peripheral hole, and then between the plug and the elastomer.

VII. Many inventive embodiments preferably use a mold release agent which is liquid (e.g., water) soluble. While the venting tube is in place, pressurized liquid (e.g., water) is fed through the venting tube so as to flow between the elastomer and the plug, thereby dissolving the liquid (e.g. water) soluble mold release agent. The plug is removed by the practitioner(s) (who is/are working from the inside of the hull) by being slidably withdrawn from the cured elastomer-coated hull. Such removal is facilitated by the mold release agent which coats the plug, and by the venting tube which allows air to vent into the resultant increasing void in the elastomer as the plug is being removed. Complete removal of the plug leaves a cavity which will conformally serve as a sort of chamber or compartment for snugly holding the device. The cavity comprises the hull opening and the maximally voluminous elastomer void (i.e., the entirely unoccupied space in the elastomer).

VIII. The device is coated with a lubricating agent.

IX. A venting tube (such as that used for plug removal) is inserted through the peripheral hole by the practitioner (who is working from the inside of the hull).

X. The cavity (which comprises the hull opening and the maximally voluminous elastomer void) has a shape which comports with that of the device. While the venting tube is in place, the lubricant-coated device is installed by the practitioner(s) (who is/are working from the inside of the hull) by being slidably advanced into the aperture. Such installation is facilitated by the lubricating agent which coats the device, and by the venting tube which allows air to vent from the resultant decreasing void in the elastomer as the device is being installed.

Once inventively installed, there is little or no gap between the device and the surrounding elastomer.

Moreover, the device can be easily removed from the interior of the submarine or other edifice. A venting tube (such as that used for plug removal or device installation) is inserted by the practitioner(s) (who is/are working from the inside of the hull) first through the peripheral hole, and then between the device and the elastomer. Again, it is preferable inventive practice for many inventive embodiments that the venting tube be lubricated (with a lubricating agent such as that used for lubricating the device as described in step VIII hereinabove) prior to insertion. Removal of the device is facilitated by the remaining lubricating agent which coats the device, and by the venting tube which allows air to vent into the resultant increasing void in the elastomer as the device is being removed.

The present invention features implementation of a plug which is constructed to be geometrically identical to a device intended to be installed. The present invention also features the provision of a cavity or chamber which defines a shape identical to that of the device as well as that of the plug.

The hull opening having been formed in conformity with the plug or the device, and the elastomeric material having been molded and cured in conformity with the plug, the device will fit inside the chamber-like cavity as well (i.e., as flushly or evenly) as does the plug when the plug is removed and the device is installed in place of the plug. Therefore, an important inventive advantage is that when the device is completely installed, little or no gap exists between the device and the surrounding elastomer.

The plug serves as a sort of temporary, precursive geometric form which is used to establish the shape of the cavity which will enclose the enduring, permanent geometric form, viz., the device. The plug is made to be an exact geometric duplicate of the device. The ordinarily skilled artisan is familiar with the various methodologies, such as involving molding techniques, for fabricating a plug which is an identical geometric copy of an original device or other object.

The plug and the device both fit the same conformal cavity, but are not necessarily identical in all geometric respects. The geometric sameness/congruency of the plug and device is inventively crucial at least with respect to the respective portions of the plug and device which are inside the chamber-like cavity when the plug or the device is in the completely installed position.

Another inventive feature is the elastomeric nature of the material layer which covers the hull or other structural wall. Since the hull coating is elastomeric, this beneficially allows for the insertion of the venting tube without removal of any elastomeric material.

It is customary for the United States Navy to cast and cure elastomer onto submarine hulls. The ordinarily skilled artisan is familiar with the conventional methodologies and techniques pertaining to such practices.

A type of substance known as a "mold release agent" is inventively used to prevent bonding of the elastomer to the plug. Thus facilitated is movement of the plug relative to the elastomer's cavity, within which the plug is retracted subsequent to cure of the elastomer. For instance, some inventive embodiments may preferably utilize, on the exterior surface of the plug, a polymer or polymer-containing material having elastomeric mold release properties; such mold release agents may be particularly well suited for effecting "mold release" of the plug from the surrounding elastomer.

There are two general categories of mold release agents, viz., "external" mold release agents and "internal" mold release agents. External mold release agents are directly applied to the mold, whereas internal mold release agents are directly added into the molding composition. In conventional practice using an external mold release agent, the release agent is typically used to coat a mold cavity in order to prevent sticking of the molded piece to the mold cavity when the molded piece is removed from the mold cavity.

Typical embodiments of the present invention will preferably implement "external" mold release agency. Before the plug is inserted in the hull opening, the plug is coated with an external mold release agent; preferably, the externally applied mold release agent has mold release properties vis-a-vis' the elastomer anticipated to surround the plug.

However, some inventive embodiments can implement "internal" mold release agency, whereby the plug is fabricated so as to include a substance or substances having mold release properties, preferably vis-a-vis' the elastomer anticipated to surround the plug.

The ordinarily skilled artisan is familiar with a variety of natural compounds, synthetic compounds and inorganic substances which are known to effectuate "mold release." Known mold release agents (also known as "release agents" or "parting agents") include waxes, soaps, silicones (e.g., silicone oil, silicone oxide powder, etc.), mineral oils, powders (e.g., talc, mica, etc.), aliphatic acid derivatives, glycols and other polymeric or polymer-containing compounds. Certain mold release agents, such as polyvinyl alcohol (PVA), are known to be especially effective in applications involving elastomers and elastomeric surfaces.

In the light of this disclosure, the ordinarily skilled artisan should be capable of practicing mold release of the plug in relation to the chamber-like cavity's hull opening and elastomer void. The following United States patents, hereby incorporated herein by reference, are merely exemplary among the plethora of United States patents pertaining to mold release agents: Jackson U.S. Pat. No. 3,935,291 issued Jan. 27, 1976; Castro et al. U.S. Pat. No. 4,101,976 issued Jul. 18, 1978; Boehmke et al. U.S. Pat. No. 4,110,119 issued Aug. 29, 1978; Horiuchi et al. U.S. Pat. No. 4,308,063 issued Dec. 29, 1981; Newkirk et al. U.S. Pat. No. 4,371,476 issued Feb. 1, 1983; Nakai U.S. Pat. No. 5,409,979 issued Apr. 25, 1995; Schur U.S. Pat. No. 4,740,324 issued Apr. 26, 1988; Franke et al. U.S. Pat. No. 4,889,908 issued Dec. 26, 1989; Piskoti U.S. Pat. No. 4,798,445 issued Jan. 10, 1989; Makus U.S. Pat. No. 4,925,882 issued May 15, 1990; Hanano U.S. Pat. No. 5,039,435 issued Aug. 13, 1991; Wagner U.S. Pat. No. 5,618,336 issued Apr. 8, 1997; Jennings et al. U.S. Pat. No. 5,883,166 issued Jun. 26, 1997; Yamana et al. U.S. Pat. No. 5,804,674 issued Sep. 8, 1998; Froeschmann U.S. Pat. No. 5,872,085 issued Feb. 16, 1999.

A further inventive feature is utilization of the venting tube, which allows the void in front of either the plug or the sensor to be ventilated or vented, thereby propitiously avoiding either a vacuum (upon withdrawal out of the void) or pressurized air (upon advancement into the void) to form in the void.

The inventive methodology allows the device to be both installed and removed in a quick, easy and inexpensive manner. In particular, the practitioner or practitioners can perform the inventive manipulative steps while being stationed on an interior deck or floor of the submarine or other edifice.

Moreover, this invention minimizes or eliminates risk of damage to the device during installation and removal. The harmoniousness which characterizes the inventive configuration promotes damage-free manipulation of the device.

The plug and the device each fit closely in the cavity. In this regard, some type of facilitative surface coating can be applied not only to the plug but also to the device. Utilization of a lubricating agent on the device, applied thereto prior to installation, is preferred for many inventive embodiments. The lubricating agent is used to promote movement of the device relative to the chamber-like cavity, within which the device is advanced during insertion and retracted during removal.

The ordinarily skilled artisan is familiar with a variety of lubricative substances (e.g., various lubricating oils) which are conventionally used to reduce friction between objects or parts in relative motion. In inventive practice, the lubricant eases installation of the device into the surrounding elastomer. The lubricant can also serve to ease deinstallation of the device from the surrounding elastomer. In the light of this disclosure, the ordinarily skilled artisan should be capable of practicing lubricatively facilitated movement of the device in relation to the cavity's hull opening and elastomer void.

Other objects, advantages and features of this invention will become apparent from the following detailed description of the invention when considered with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
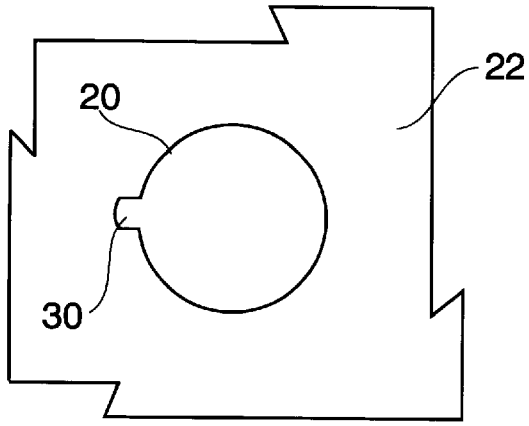
FIG. 1 is a diagrammatic elevational view of a portion of a submarine hull wherein is inventively provided, in a submarine hull, a substantially round hole which includes a slot.
Figure 2:
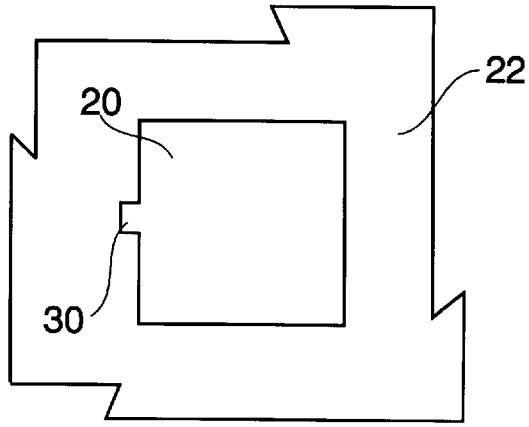
FIG. 2 is a diagrammatic elevational view of a portion of a submarine hull wherein is inventively provided, in a submarine hull, a substantially square hole which includes a slot.
Figure 3:
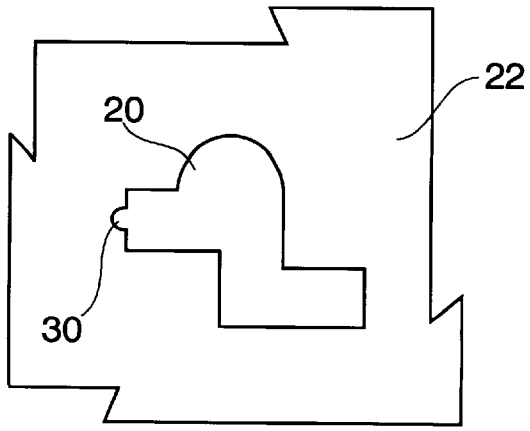
FIG. 3 is a diagrammatic elevational view of a portion of a submarine hull wherein is inventively provided, in a submarine hull, a hole which includes a slot and is characterized by asymmetry, rectilinearity and curvilinearity.

Referring now to FIG. 1 through FIG. 3, hole 20 having slot 30 is produced in submarine hull 22. With the notable exception of the deviation represented by slot 30, hole 20 shown in FIG. 1 is cross-sectionally circular in shape, and hole 20 shown in FIG. 2 is cross-sectionally square in shape. Irregular, asymmetrical hole 20 shown in FIG. 3 cross-sectionally is partially curvilinear (e.g., elliptical) and partially rectilinear (e.g., polygonal) in shape. The two profiles shown in FIG. 1 and FIG. 2 are approximately regular, and in fact are approximately axially symmetrical. Hole 20 shown in FIG. 1 is substantially a circle, whereas hole 20 shown in FIG. 2 is substantially a type of regular polygon.

Figure 4:
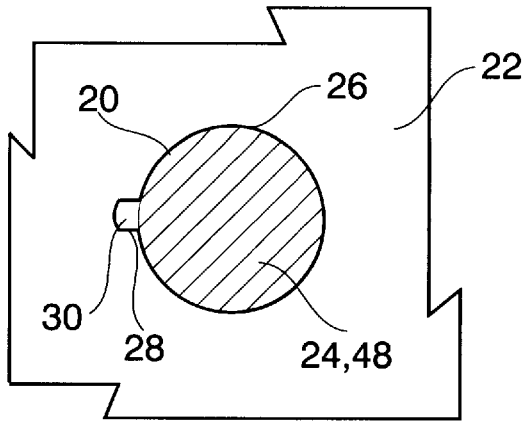
FIG. 4 is the view of FIG. 1 illustrating accommodation by the substantially round hole of an agreeably shaped plug or device.
Figure 5:
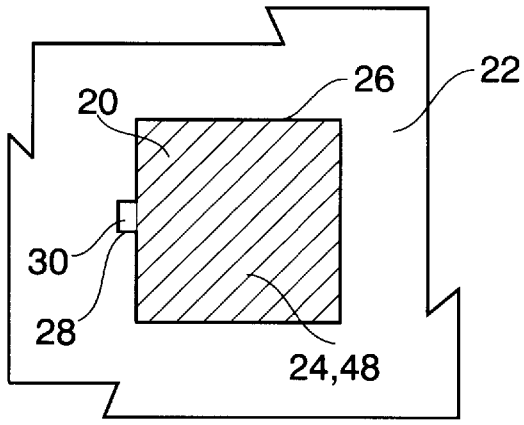
FIG. 5 the view of FIG. 2 illustrating accommodation by the substantially square hole of an agreeably shaped plug or device.
Figure 6:
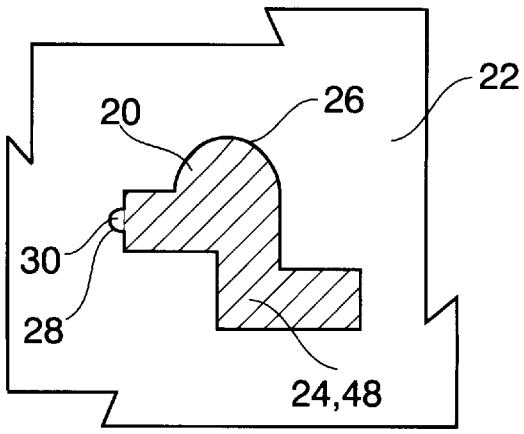
FIG. 6 the view of FIG. 3 illustrating accommodation by the irregularly shaped hole of an agreeably shaped plug or device.

With reference to FIG. 4 through FIG. 6, the entity which occupies hole 20 can be conceived to be, in fully installed position, either plug 24 or sensor 48. Since plug 24 and sensor 50 have the identical external geometric form, it is convenient to refer to the occupant of hole 20 as "plug/sensor 24/48."

Hole 20 and plug/sensor 24/48 shown in FIG. 1 and FIG. 4 each define the same circular outline or cylindrical figure. Hole 20 and plug/sensor 24/48 shown in FIG. 2 and FIG. 5 each define the same square outline or box figure. Hole 20 and plug/sensor 24/48 shown in FIG. 3 and FIG. 6 each define the same irregular figure or outline.

Hole 20 has a configuration which substantially agrees with the configuration of solid plug 24 as well as of sensor 48. Major hole perimeter portion 26 comports with plug/sensor 24/48. However, minor hole perimeter portion 28 provides slot 30 between plug/sensor 24/48 and hole 20. The outside surface of plug/sensor 24/48 is even or flush with the inside surface of major hole perimeter portion 26, but leaves a gap relative to the inside surface of minor hole perimeter portion 28.

Figure 8:
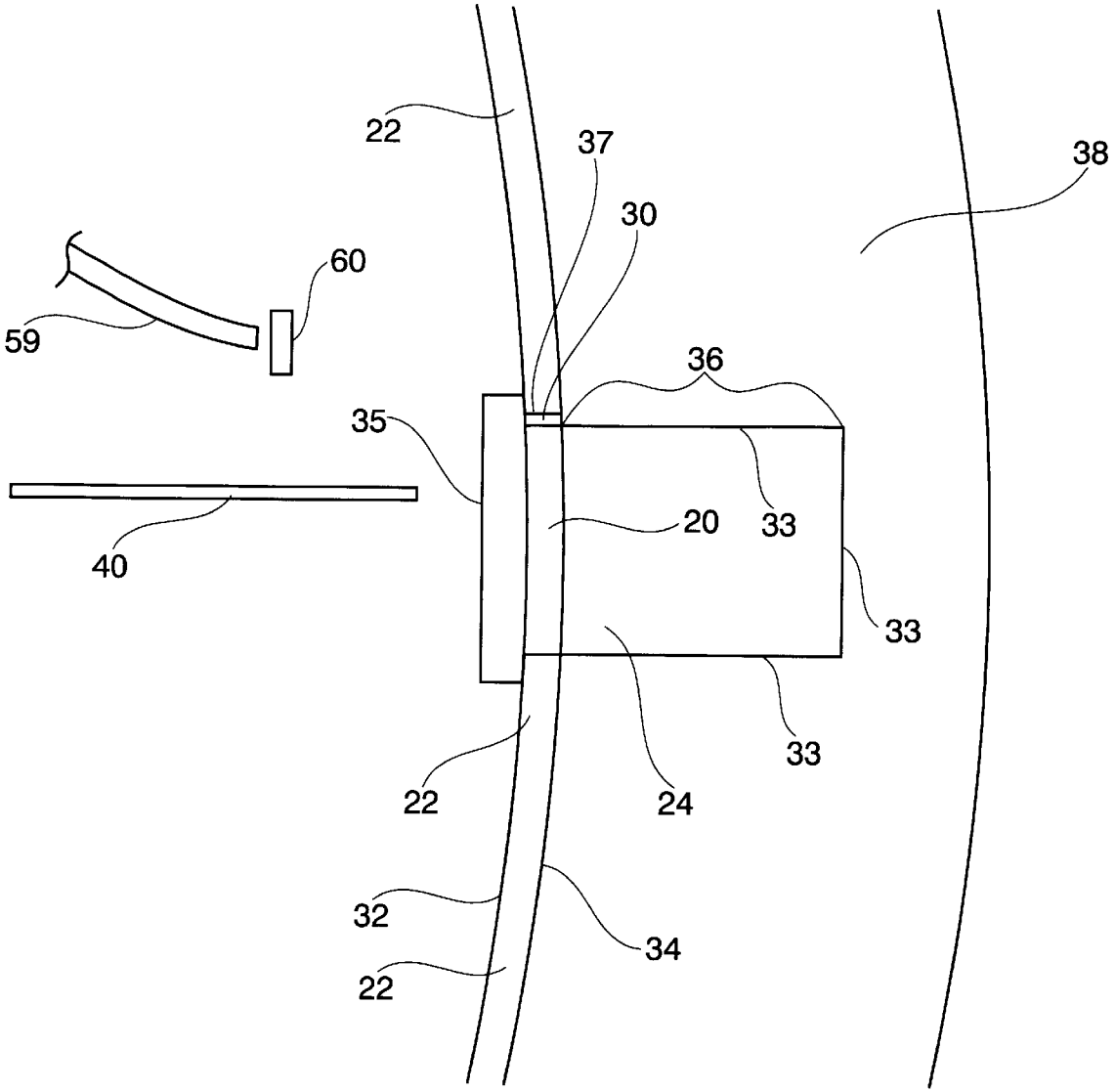
FIG. 8 is view, similar to the view shown in FIG. 7, of an inventive embodiment wherein the plug is shown installed in place and encompassed by the cured elastomer.
Figure 9:
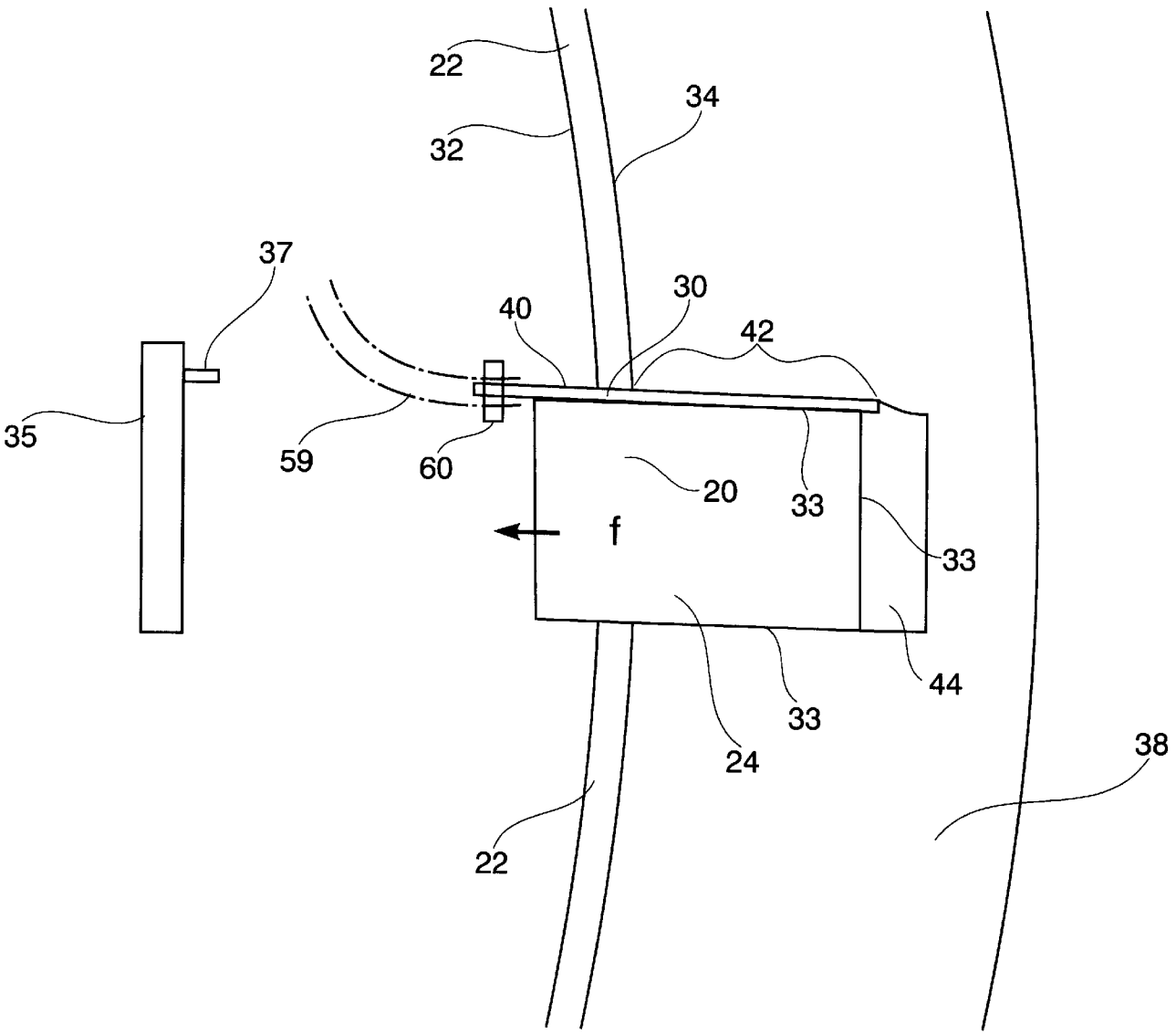
FIG. 9 is a view, similar to the view shown in FIG. 7 and FIG. 8, of an inventive embodiment wherein the plug shown installed in FIG. 4 is shown being removed.

Plug 24 has the same three-dimensional geometrical shape as that of the to-be-installed sensor 48. That is, solid plug 24 shown in FIG. 8 and FIG. 9 is a geometric duplicate of sensor 40 shown in FIG. 11 and FIG. 12. As similarly shown in FIG. 1, FIG. 2 and FIG. 3, hole 20 is suitably shaped for plug 24, and hence is suitably shaped for sensor 48. Major hole perimeter portion 26 comports with plug/sensor 24/48, whereas minor hole perimeter portion 28 provides slot 30 between plug/sensor 24/48 and hole 20.

Inventive practice admits of a variety of cross-sectional shapes and sizes of hole 20 and its corresponding plug/sensor 24/48. There are many possible polygonal cross-sectional shapes, other than the square shape shown in FIG. 2 and FIG. 5, for hole 20 and plug/sensor 24/48, e.g., triangular, (non-square) rectangular, pentagonal, hexagonal, septagonal, octagonal, nonagonal, decagonal, etc. There are also many possible elliptical shapes other than the circular shape shown in FIG. 1 and FIG. 4. There is also a diversity of possible hybridized rectilinear/curvilinear shapes other than that which is shown in FIG. 3 and FIG. 6. The contours of hole 20 and plug/sensor 24/48 are certainly not required by this invention to be either regular or axially symmetrical.

In accordance with the present invention, hole 20 and its corresponding plug 24 and sensor 48 can each have any cross-sectional shape, regular or irregular, which permits inventive practice. In fact, the cross-sectional shape of hole 20 and plug/sensor 24/48 can have any combination of indicia of curvilinearity and/or rectilinearity, so long as inventive practice is permitted thereby.

Generally, in inventive practice, slot 30 admits of a variety of two-dimensional and three-dimensional shapes and sizes, and a variety of locations with respect to hole 20. Slot 30, located at the perimeter of hole 20, can be located at any perimetric location on hole 20 which is reasonable accessible to the inventive practitioner and which coheres with the overall configuration of the inventive plug assembly. A related consideration is that slot 30 should be cross-sectionally sized as small as possible while enabling the facile insertion therethrough of a tubular device for properly effectuating venting according to this invention.

FIG. 7 through FIG. 12 sequentially illustrate the inventive methodology.

Figure 7:
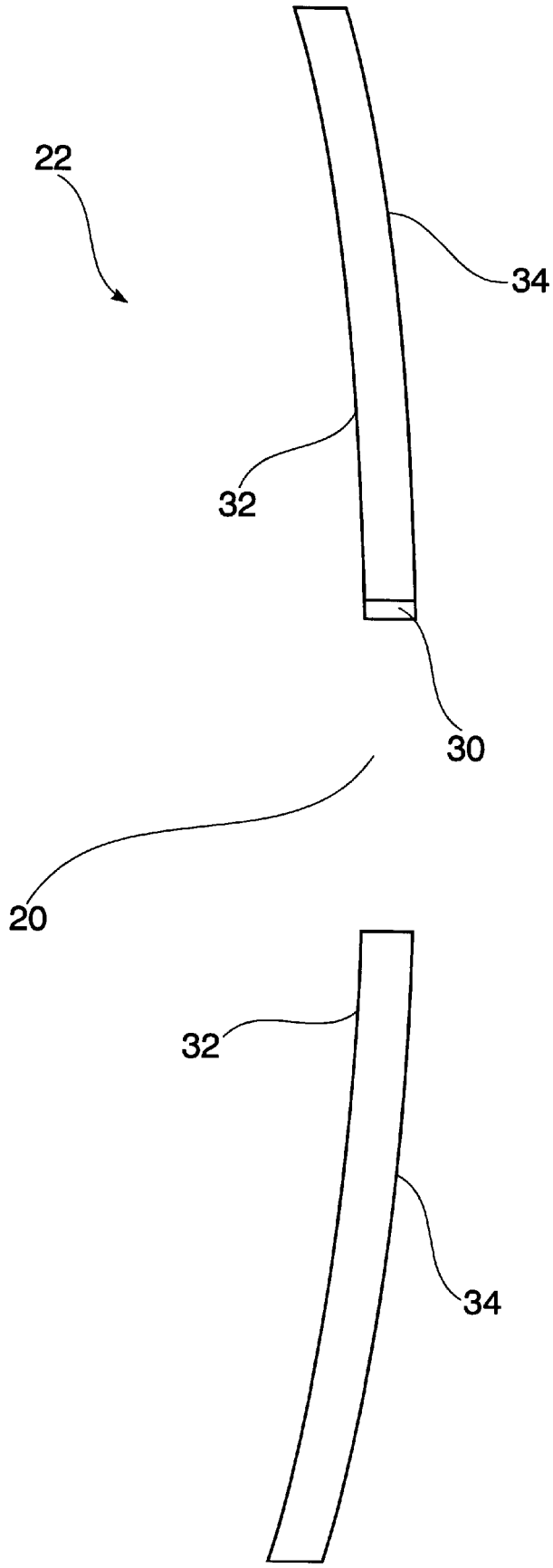
FIG. 7 is a diagrammatic sectional plan view of an inventive embodiment wherein a section of the wall is shown to be provided with a hole which includes a slot.

Reference now being made to FIG. 7, hull 22 has front hull surface 32, back hull surface 34, and hole 20 which includes slot 30. Hull surfaces 32 and 34 are approximately vertical and are designated "front" (anterior) and "back" (rear or posterior), respectively, based on the perspective of the inventive practitioner.

Referring to FIG. 8, for many inventive embodiments, coupled with plug 24 is a removable, collar-like retaining plate 35 which includes a stopper-like projection 37. The conformance of projection 37 with respect to slot 30 is perhaps best illustrated in FIG. 9, wherein projection 37 is shown separated from slot 30. Projection 37 has approximately the same three-dimensional geometric shape as has slot 30. In this regard, projection 37 and slot 30 are characterized not only by approximately the same cross-sectional shape but also by approximately the same length. Projection 37 serves to prevent uncured elastomer from entering slot 30.

The exterior surface of solid plug 24 is coated with mold release agent 33. At front hull surface 32, plug 24 is inserted in hole 20.

In typical inventive embodiments wherein a retaining plate 35 is implemented, retaining plate 35 is applied to plug 24 (to help keep it set) prior to casting and curing elastomer 38 with respect to back hull surface 34. Many such inventive embodiments provide for engagement of retaining plate 35 with plug 24 prior to insertion of plug 24 in hole 20; some such inventive embodiments, however, provide for engagement of retaining plate 35 with plug 24 subsequent to insertion of plug 24 in hole 20.

When in the fully inserted position, as shown in FIG. 8, plug 24 has protrusive plug portion 36 which extends aft of back hull surface 34. Removable retaining plate 35 affixes plug 24 to submarine hull 22 at front hull surface 32. Slot 30 is available in hull 22 for receiving the venting tube 40.

Subsequent to complete insertion of plug 24 in hole 20, castable elastomer hull coating 38 is cast onto back hull surface 34 so as to envelop protrusive plug portion 36. The cast elastomer hull coating 38 is cured. Previously uncovered, structural hull 22 is now layered with elastomer 38.

With reference to FIG. 9, after elastomer hull coating 38 is cured, retaining plate 35 is removed to permit installation of venting tube 40. A small diameter metal venting tube 40 is lubricated (with a lubricating agent such as lubricant 50) to allow ease of insertion. Then, the venting tube 40 is inserted. Venting tube 40 is caused to enter slot 30 at front hull surface 32. Venting tube 40 is advanced into and through slot 30, and continued to be advanced by slipping between plug 24 and the deforming adjacent elastomer 38. Venting tube 40 is moved in the backward or rearward direction (away from the practitioner), approximately in the direction indicated by arrow b in FIG. 11, as far back as necessary to effectuate venting during removal of plug 24.

Protrusive venting tube portion 42 is the portion of venting tube 40 which extends behind back hull surface 34. Generally, protrusive venting tube portion 42 will extend behind back hull surface 34 approximately as far as extends protrusive plug portion 36.

Many inventive embodiments preferable utilize, for coating plug 24, a mold release agent 33 which is soluble by a liquid such as water. A rinsing tube 59 (preferably flexible, e.g., made of plastic), such as shown in FIG. 8 and FIG. 9, is used for washing or flushing away the mold release agent 33. In inventive practice generally, the rinsing via rinsing tube 59 should precede the venting via venting tube 40.

Rinsing tube 59 is detachably attached to venting tube 40 (at the venting tube 40 end which is in front of front hull surface 32) by means of a retaining collar 60. Depending on the inventive embodiment, this connection of venting tube 40 with rinsing tube 59 can be effected either prior to or subsequent to fully extended placement of venting tube 40 through slot 30, in association with removal of plug 24.

If mold release agent 33 is water soluble, pressurized water is caused to flow through rinsing tube 59 to back hull surface 34 so as to contact all or a substantial portion of the water soluble mold release agent 33 which coats plug 24, thereby dissolving water soluble mold release agent 33. Some inventive embodiments utilize, for coating plug 24, a mold release agent 33 which is soluble by a liquid other than water; in accordance therewith, the appropriate liquid is utilized is a similar fashion for accomplishing dissolution of the liquid soluble mold release agent 33.

Once mold release agent 33 has been dissolved, rinsing tube 59 and retaining collar 60 are preferably removed from venting tube 40 prior to venting by means of venting tube 40, in order that venting tube 40 effectively conduct the flow of air during withdrawal of plug 24.

Subsequent to disconnection of rinsing tube 59 from venting tube 40, while venting tube 40 is appropriately situated the practitioner begins to slidably move plug 24 in a frontward or forward direction (toward the practitioner) as shown by arrow f. Properly inserted venting tube 40 allows air to vent into the resultant void 44 while plug 24 is being displaced from cured elastomer hull coating 38. The volume of elastomeric void 44 increases in accordance with amount of retraction of plug 24. Mold release agent 33, which covers plug 24, eases removability of plug 24 from the surrounding elastomer 38.

Figure 10:
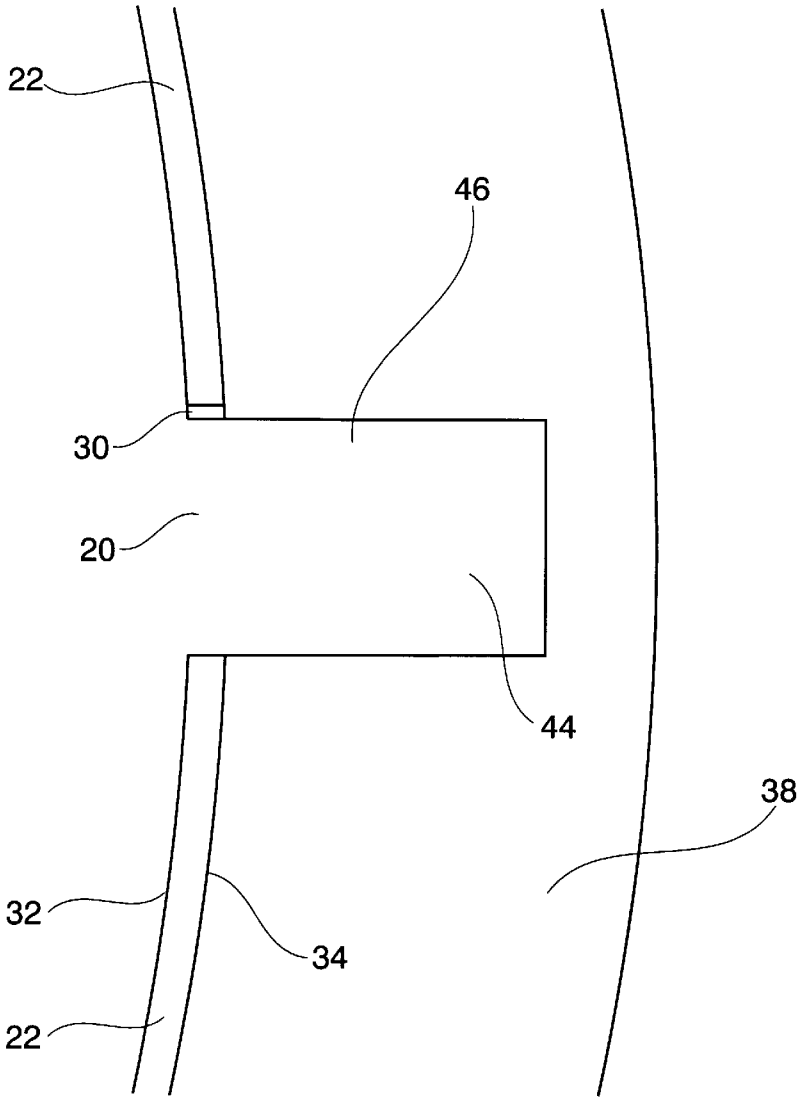
FIG. 10 is a view, similar to the views shown in FIG. 7 through FIG. 9, of an inventive embodiment wherein is shown (subsequent to removal of the plug as shown in FIG. 9) an empty chamber which was previously occupied by the plug.

Referring to FIG. 10, when plug 24 is completely removed, chamber-like cavity 46 remains, comprising empty hole 20 and empty elastomeric void 44.

Figure 11:
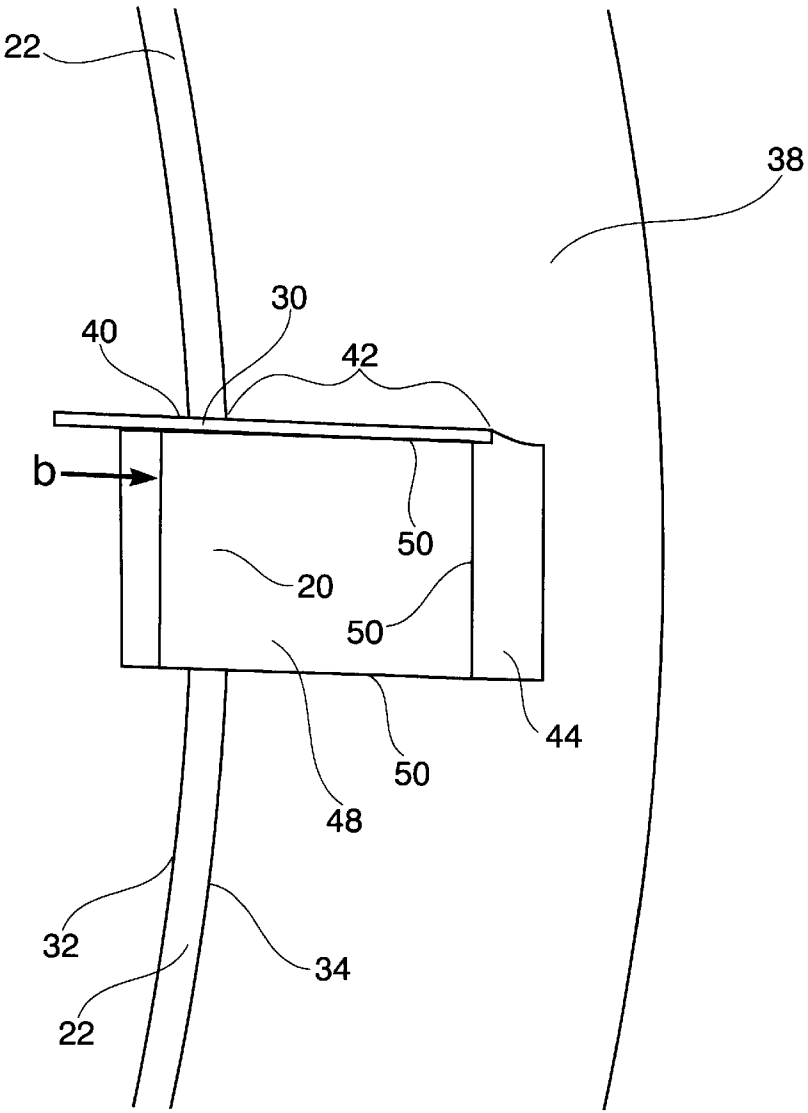
FIG. 11 is a view, similar to the views shown in FIG. 7 through FIG. 10, of an inventive embodiment wherein the sensor is shown being installed in the chamber shown in FIG. 10.

With reference to FIG. 11, sensor 48 is coated with lubricating agent 50, thereby allowing for easy insertion into elastomer 38. Small diameter metal venting tube 40 (the same as, or similar to, the venting tube 40 used for removal of plug 24 as shown in FIG. 8) is inserted through the peripheral slot 30. Venting tube 40 is caused to enter slot 30 at front hull surface 32.

Insertion of venting tube 40 can be accomplished prior to, and/or approximately contemporaneous with, insertion of sensor 48. The practitioner will exercise ordinary skill in accomplishing, without difficulty, installation of sensor 48; that is, the practitioner will bring to bear the requisite degree of finesse for coordinating his/her efforts in association with venting tube 40 and sensor 48.

Depending on the inventive embodiment, the ordinarily skilled artisan may adjudge that venting tube 40 should be covered with a lubricating agent (such as lubricant 50) to facilitate the procedure when used in association with installation of sensor 48. In inventive practice generally, the practitioner should consider lubricating venting tube 40 on any occasion of its insertion, including when venting tube 40 is used in association with: removal of plug 40; installation of sensor 48; and, removal of sensor 48.

Depending on the inventive embodiment, the practitioner will: (i) completely advance venting tube 40, then proceed to advance sensor 48; or, (ii) advance venting tube 40 and sensor 48 approximately at the same time; or, (iii) at various times, advance venting tube 40 and sensor 48 together or separately. Regardless of the technique, the practitioner should be sure to position the onward end of protrusive venting tube portion 42 (the portion of venting tube 40 which extends behind back hull surface 34) so that it precedes the onward end of protrusive sensor portion 52 (the portion of sensor 48 which extends behind back hull surface 34)—in particular, so that venting tube 40 appropriately interacts with void 44 in advance of advancing sensor 48.

In general, venting tube 40 is advanced into and through slot 30 and continued to be advanced huggingly along the adjacent elastomer 38. Venting tube 40 is moved by the practitioner in a backward direction (away from the practitioner), approximately as shown by arrow b, far back as necessary to continually effectuate venting during advancement of sensor 48. The practitioner also moves sensor 48, slidably in a backward direction (away from the practitioner), approximately as shown by arrow b.

Properly inserted venting tube 40 allows air to vent from void 44, in front of the advancing sensor 48, while sensor 48 advancing into cured elastomer hull coating 38. The volume of elastomeric void 44 decreases in accordance with amount of advancement of sensor 48. Lubricant 50, which covers sensor 48, eases insertability of sensor 48 within the surrounding elastomer 38.

Figure 12:
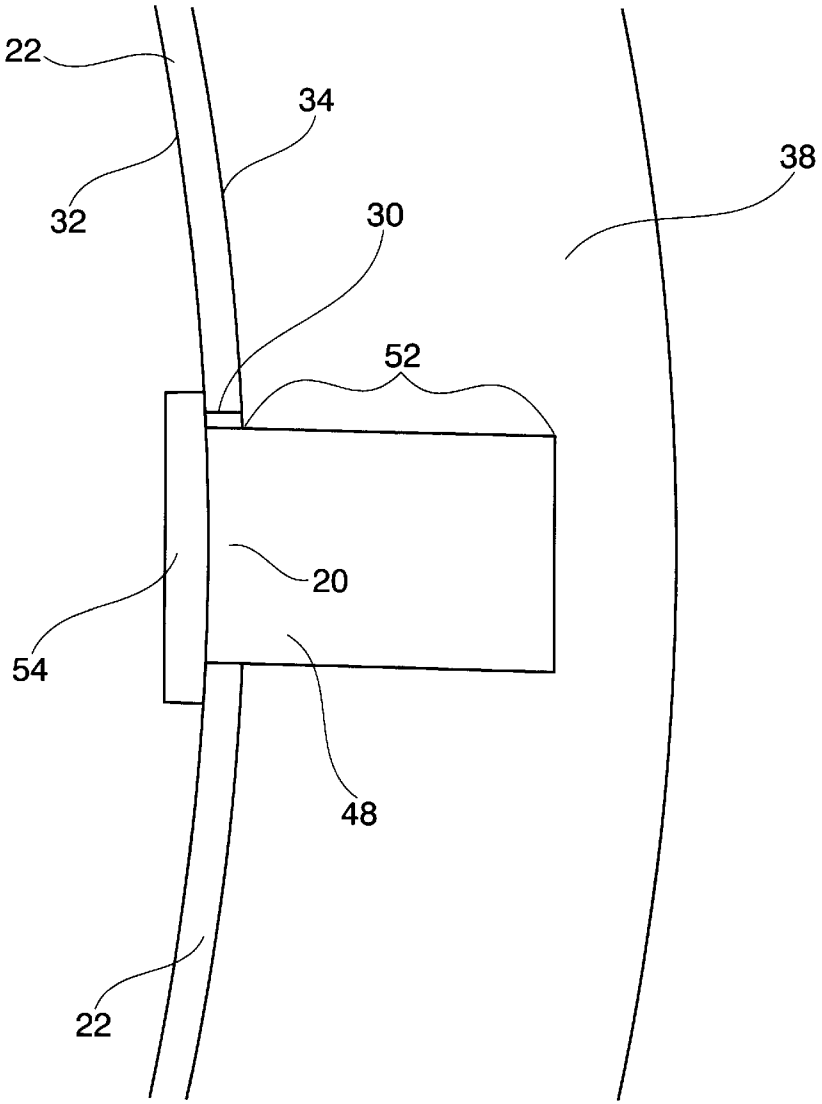
FIG. 12 is a view, similar to the views shown in FIG. 7 through FIG. 11, of an inventive embodiment wherein the sensor shown being installed in FIG. 11 is shown installed in place, encompassed by the cured elastomer.

Still referring to FIG. 11 and also referring to FIG. 12, venting tube 40 is removed after sensor 48 is fully installed—i.e., after sensor 48 is completely flush with the surrounding elastomer 38. Generally, when sensor 48 is completely inserted, protrusive venting tube portion 42 will extend behind back hull surface 34 approximately as far as will extend protrusive sensor portion 52. Upon complete installation of sensor 48, venting tube 40 is removed by being withdrawn approximately in the direction shown by arrow f in FIG. 9.

When in the fully inserted position, as shown in FIG. 12, sensor 48 has protrusive sensor portion 52 which extends aft of back hull surface 34. As shown in FIG. 12, the exterior surface of protrusive sensor portion 52 is flush on all sides with respect to the interior surface of elastomeric void 44. For many inventive embodiments, a removable sensor mount 54 is installed on sensor 48 in order to permanently mount sensor 48 to submarine hull 22.

The three-dimensional geometric shape of plug/sensor 24/48 can have attributes of curvilinearity and/or rectilinearity. In accordance with many embodiments of the present invention, plug/sensor 24/48 is approximately or substantially characterized by an axially symmetrical shape, such as parallelipiped (e.g., box-like), cylindrical or conical section. However, according to this invention, plug/sensor 24/48 need not be characterized by symmetry or regularity of any kind. There are two basic inventive requirements regarding the shape of plug/sensor 24/48.

First, the shape of plug/sensor 24/48 must permit installation and removal of plug/sensor 24/48. Plug/sensor 24/48 must be characterized by a shape which lends itself to such installation in a forward direction (generally in accordance with arrow f, either parallelly or coincidentally) and removal in a backward direction (generally in accordance with arrow b, either parallelly or coincidentally). Direction arrows f and be are opposite counterparts of the same bidirection, i.e., a forward direction and a backward direction which are coincidental or parallel.

During installation or removal according to many inventive embodiments, plug/sensor 24/48 traces a path which is approximately straight (linear). However, according to this invention, the path traced by the advancing or withdrawing plug/sensor 24/48 can be straight, curved and/or jagged—so long as the inventive bidirectional movement (in both opposite ways) of plug/sensor 24/48 is inventively practicable. Plug/sensor 24/48 must be sufficiently freely movable in both the forward and backward directions; that is, without undue difficulty, the plug/sensor 24/48 must be completely introducible into, and completely withdrawable out of, the conformal cavity.

Second, the shape of the plug/sensor 24/48 must permit insertion and removal of venting tube 40. It can be conceived that plug/sensor 24/48 is characterized as having a surface portion which lends itself therealong to such insertion and removal. A slot 30 must be providable at the perimeter of hole 20 in wall 22. Venting tube 40 must fit through slot 30 and be completely insertible in, and removable from, conformal chamber-like cavity 46, while venting tube 40 is moving (e.g., sliding) tangentially along an adjacent surface portion of plug/sensor 24/48 and/or an adjacent surface portion of elastomeric void 44.

Inventive practice will generally demand a firm and rigid external construction of both plug 24 and sensor 48. The composition of either plug 24 or sensor 24/48 can include any material having these properties, such as wood, metal, plastic, hard rubber or composite. According to frequently preferred inventive practice, plug 24 is a solid piece made of a strong material (e.g., plastic or rubber) which has been molded, in a conventional process, in geometric likeness to or identity with sensor 48. Some inventive embodiments provide a solid hard rubber plug 24 which is analogous to an ice hockey puck. A typical sensor 48 or other device which is inventively installed will have a metallic or plastic casing.

Generally, in inventive practice venting tube 40 will have to be sufficiently rigid to permit insertion into the cavity. For most inventive embodiments venting tube 40 will be straight and rigid, although venting tube 40 could conceivably be slightly or moderately curved and/or slightly or moderately flexible for some inventive embodiments.

Described herein in relation to FIG. 7 through FIG. 12 are some inventive embodiments wherein submarine hull 22 is relatively thin, and a substantial portion of the installed device (protrusive sensor portion 52) extends beyond hull 22 and into elastomeric layer 38. Frequently, such inventive embodiments require implementation of mechanical means such as a removable plug retaining plate 35 (for plug 24) and a removable sensor mount 54 (for sensor 48).

Figure 13:
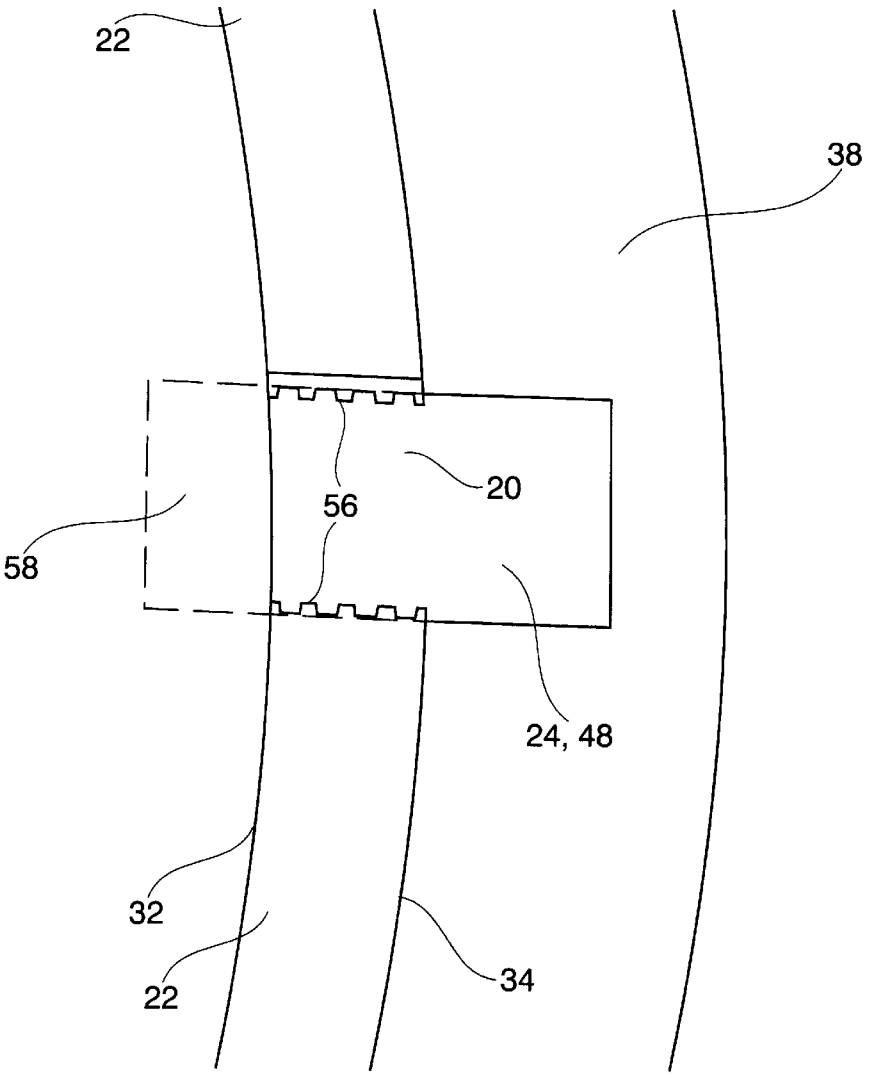
FIG. 13 is a view, similar to the views shown in FIG. 7 through FIG. 12, of an inventive embodiment wherein the plug and its corresponding sensor are each identically characterized by a straight cylindrical shape, and are each identically provided with spiral threads for screw engagement with a hole in a submarine hull, the inside hole periphery having been complemetarily provided with spiral threads for such engagement.
Figure 14:
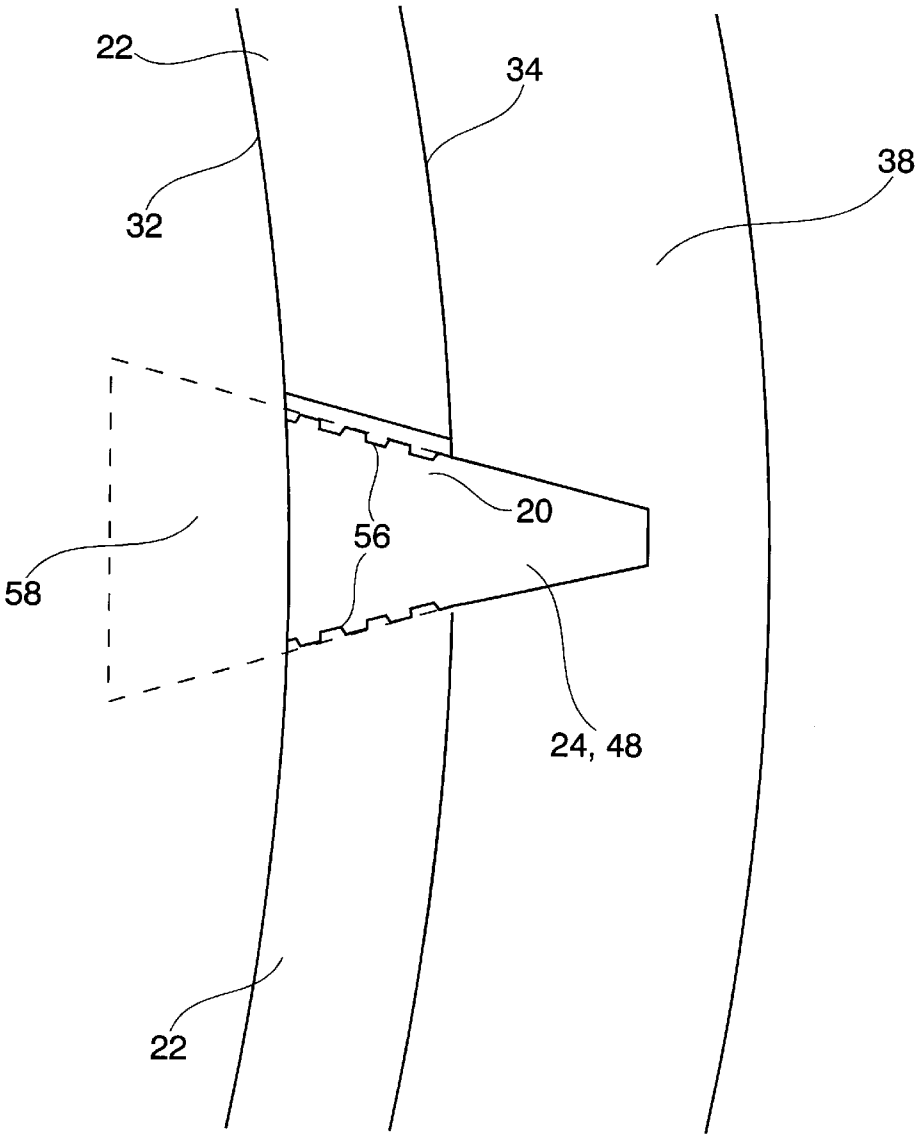
FIG. 14 is a view, similar to the views shown in FIG. 7 through FIG. 13, of an inventive embodiment (similar to the inventive embodiment shown in FIG. 13) wherein the plug and its corresponding sensor are each identically characterized by a tapered cylindrical shape, and are each identically provided with spiral threads for screw engagement with a hole in a submarine hull, the inside hole periphery having been complemetarily provided with spiral threads for such engagement.

However, according to some inventive embodiments, the structural wall (e.g., submarine hull 22) is thick enough to enable threaded engagement of the device (e.g., sensor 48) with the structural wall, and/or threaded engagement of the plug (e.g., plug 24) with the structural wall. Referring to FIG. 13 and FIG. 14, the installed object (which appears in two dimensions to be rectangular and trapezoidal, respectively, in FIG. 13 and FIG. 14) can be conceived to be either sensor 48 or plug 24. The cross-sectional shape of plug/sensor 24/48 is approximately circular such as shown in FIG. 4.

As shown in FIG. 13 and FIG. 14, hull 22 is thick enough to permit threaded engagement 56 of the circumferential outside surface of device/plug 24/48 with the circumferential inside surface of the hole 20 in hull 22. A portion of the outside circumferential surface of cylindrical plug/sensor 24/48 is threaded like a screw. The inside circumferential surface of hole 20 is threaded in complementary fashion. Plug/sensor 24/48 is shown in FIG. 13 to be approximately cylindrical. Plug/sensor 24/48 is shown in FIG. 14 to be cylindrically tapered—i.e., shaped like a section of a cone.

Still referring to FIG. 13 and 14, and again referring to FIG. 7 through FIG. 12, installed plug/sensor 24/48 is shown in FIG. 7 through FIG. 12 to approximately be flat and vertically even with front hull surface 32. However, in inventive practice, neither sensor 48 nor plug 24 need be vertically even with front hull surface 32 when installed.

With reference to FIG. 13 and FIG. 14, threaded engagement 56 of plug/sensor 24/48 with hole 20 obviates the need for approximate vertical evenness of plug/sensor 24/48 with front hull surface 32 (although such disposition may nonetheless be desirable in particular applications). That is, frequently unnecessary in practicing such inventive embodiments is the utilization of either a removable retaining plate 35 to secure plug 24, or a removable mount 54 to secure sensor 48. Installed cylindrical plug/sensor 24/48 shown in FIG. 13, and installed conical plug/sensor 24/48 shown in FIG. 14, each have a frontally projective portion 58 (indicated by dashed line) which juts out forward of front hull surface 32.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A method for removably installing an object in a structural wall, said method comprising:

providing in said wall an opening, said opening having a conformal opening portion and a nonconformal opening portion, said conformal opening portion at least substantially describing the peripheral shape of said object when said object is inserted through said opening, said nonconformal opening portion affording a space when said object is inserted through said opening;

providing a member, said member at least substantially defining the geometric shape which is defined by said object;

at least partially coating said member with a substance characterized by mold release agency;

inserting said member through said opening so that a section of said member extends beyond said wall, and so that said nonconformal opening portion affords approximately the same said space;

casting and curing an elastomeric layer with respect to said wall SO that said section of said member is at least substantially surrounded by said elastomeric layer;

inserting a conduit through said space, and between said elastomeric layer and said section of said member;

withdrawing said member from said opening, thereby leaving a hollow in said elastomeric layer; and inserting said object through said opening so that a section of said object at least substantially occupies said hollow in said elastomeric layer.

2. A method for removably installing an object as in claim 1, comprising, prior to inserting said object through said opening, engaging said member with a restraining plate.

3. A method for removably installing an object as in claim 1, wherein said substance is soluble by a liquid, and wherein said withdrawing said member from said opening includes:

implementing said conduit for conducting said liquid so that said liquid has a dissolving effect with respect to said substance; and implementing said conduit for conducting air into the portion of said hollow which is beyond said member.

4. A method for removably installing an object as in claim 1, comprising, prior to inserting said object through said opening, inserting a conduit through said space.

5. A method for removably installing an object as in claim 4, wherein said inserting said object through said opening includes implementing said conduit for conducting air from the portion of said hollow which is beyond said object.

6. A method for removably installing an object as in claim 1, comprising, subsequent to inserting said member through said opening, fastening said member with respect to said wall.

7. A method for removably installing an object as in claim 6, wherein said fastening includes utilizing a retainer plate.

8. A method for removably installing an object as in claim 1, comprising, subsequent to inserting said object through said opening, fastening said object with respect to said wall.

9. A method for removably installing an object as in claim 8, wherein said fastening includes utilizing a mount.

10. A method for removably installing an object as in claim 1, comprising, subsequent to inserting said object through said opening, withdrawing said object from said opening, thereby leaving said hollow in said elastomeric layer.

11. A method for removably installing an object as in claim 10, comprising, prior to withdrawing said object from said opening, inserting a conduit through said space, and between said elastomeric layer and said section of said object.

12. A method for removably installing an object as in claim 11, wherein said withdrawing said object from said opening includes implementing said conduit for conducting air into the portion of said hollow which is beyond said object.

13. A method for removably installing a body in a structure, said structure having a front side and a back side, said method comprising:

from said front side, positioning a geometric facsimile of said body in an opening in said structure so that a hiatus abuts said geometric facsimile, and so that a part of said geometric facsimile is a protrusive facsimile part, said protrusive facsimile part protruding behind said back side;

curing elastomeric material onto said back side so that said cured elastomeric material encompasses said protrusive facsimile part;

from said front side, positioning a duct in said hiatus so that a part of said duct is a protrusive duct part, said protrusive duct part protruding behind said back side approximately coextensively with said protrusive facsimile part;

from said front side, removing said geometric facsimile from said opening; and from said front side, positioning said body in said opening so that a part of said body is a protrusive body part, and so that said cured elastomeric material encompasses said protrusive body part, said protrusive body part protruding behind said back side approximately coincidentally as protruded said protrusive facsimile part of said positioned geometric facsimile.

14. A method for removably installing a body as in claim 13, comprising, before positioning said geometric facsimile, producing said opening.

15. A method for removably installing a body as in claim 13, comprising, after removing said geometric facsimile from said opening:

from said front side, positioning said duct in said hiatus so that said protrusive duct part protrudes behind said back side approximately coincidentally as protruded said protrusive duct part which protruded approximately coextensively with said protrusive facsimile part.

16. A method for removably installing a body as in claim 13, comprising, at least partially in concurrence with said positioning said body in said opening:

from said front side, positioning said duct in said hiatus so that said protrusive duct part protrudes behind said back side at least approximately coextensively with said protrusive body part.

17. A method for removably installing a body as in claim 13, wherein said positioning said geometric facsimile includes using removable retaining means in association with said front side and said geometric facsimile.

18. A method for removably installing a body as in claim 13, wherein said positioning said body includes using removable mounting means in association with said front side and said body.

19. A method for removably installing a body as in claim 13, comprising, after positioning said body:

from said front side, removing said body from said opening.

20. A method for removably installing a body as in claim 19, comprising, before removing said body:

from said front side, positioning said duct in said hiatus so that said protrusive duct part protrudes behind said back side approximately coextensively with said protrusive body part.

* * * * *